US011384483B2

(12) United States Patent
Takahashi et al.

(10) Patent No.: US 11,384,483 B2
(45) Date of Patent: Jul. 12, 2022

(54) TISSUE PAPER

(71) Applicants: DAIO PAPER CORPORATION, Shikokuchuo (JP); TOHOKU UNIVERSITY, Sendai (JP)

(72) Inventors: Sachiko Takahashi, Fujinomiya (JP); Kazuo Hokkirigawa, Sendai (JP); Takeshi Yamaguchi, Sendai (JP); Kei Shibata, Sendai (JP)

(73) Assignees: DAIO PAPER CORPORATION, Ehime (JP); TOHOKU UNIVERSITY, Miyagi (JP)

( * ) Notice: Subject to any disclaimer, the term of this patent is extended or adjusted under 35 U.S.C. 154(b) by 0 days.

(21) Appl. No.: 17/058,478

(22) PCT Filed: Jun. 3, 2019

(86) PCT No.: PCT/JP2019/021962

§ 371 (c)(1),
(2) Date: Nov. 24, 2020

(87) PCT Pub. No.: WO2019/235416

PCT Pub. Date: Dec. 12, 2019

(65) Prior Publication Data

US 2021/0198850 A1 Jul. 1, 2021

(30) Foreign Application Priority Data

Jun. 4, 2018 (JP) ..... JP2018-107229

(51) Int. Cl.

| | |
|---|---|
| ***D21H 27/30*** | (2006.01) |
| ***A47K 10/16*** | (2006.01) |
| ***D21H 27/00*** | (2006.01) |

(52) U.S. Cl.
CPC ..... *D21H 27/30* (2013.01); *A47K 10/16* (2013.01); *D21H 27/005* (2013.01)

(58) Field of Classification Search
CPC .... D21H 27/30; D21H 27/005; D21H 27/002; D21H 27/02; A47K 10/16
See application file for complete search history.

(56) References Cited

U.S. PATENT DOCUMENTS

| | | | | |
|---|---|---|---|---|
| 10,570,568 | B2 * | 2/2020 | Yasui | D21H 27/30 |
| 2011/0024066 | A1 | 2/2011 | Matsumura et al. | |
| 2018/0258592 | A1 * | 9/2018 | Yasui | A47K 10/16 |
| 2021/0123190 | A1 * | 4/2021 | McKee | D21H 27/02 |
| 2021/0172925 | A1 * | 6/2021 | Yasui | D21H 27/005 |
| 2021/0198850 | A1 * | 7/2021 | Takahashi | D21H 27/30 |
| 2021/0372053 | A1 * | 12/2021 | Manifold | D21H 27/005 |

FOREIGN PATENT DOCUMENTS

| | | | |
|---|---|---|---|
| JP | 2006-045690 | A | 2/2006 |
| JP | 2009-263837 | A | 11/2009 |
| JP | 2013-236904 | A | 11/2013 |
| JP | 2016-182187 | A | 10/2016 |
| JP | 2017-055808 | A | 3/2017 |
| JP | 2017-113223 | A | 6/2017 |
| JP | 2017-176482 | A | 10/2017 |
| JP | 2017-192435 | A | 10/2017 |
| JP | 2018-053391 | A | 4/2018 |
| JP | 2018-057691 | A | 4/2018 |

OTHER PUBLICATIONS

Machine Translation of WO 2018061318 A1. (Year: 2018).*

* cited by examiner

*Primary Examiner* — Jose A Fortuna
(74) *Attorney, Agent, or Firm* — Arthur M. Reginelli; Renner, Kenner

(57) ABSTRACT

The present invention is directed to a non-moisturizing high-grade type tissue paper having excellent softness wherein the polyol applied to the two-ply tissue paper is not applied by external addition. In various embodiments, the tissue paper has a basis weight per ply of 14.0 to 17.0 g/m$^2$, a paper thickness for two plies of 160 to 220 μm, and a water content of 4.0 to 9.0% by mass, contains 0.15 to 0.45% by mass of an oily component to be extracted with diethyl ether, and has a bending rigidity of less than 0.006 gf·cm/cm in CD (cross direction) and a bending recovery force of less than 0.005 gf·cm/cm in CD.

7 Claims, 1 Drawing Sheet

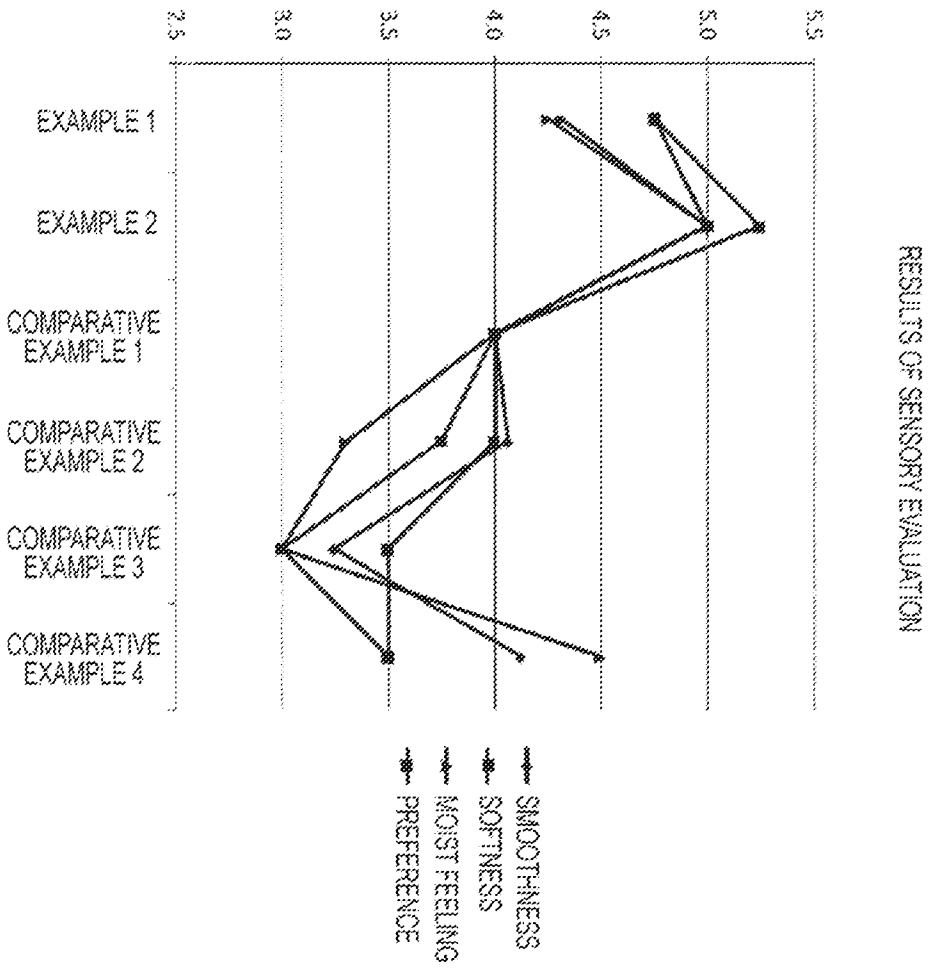
RESULTS OF SENSORY EVALUATION
5.5
5.0
4.5
4.0
3.5
3.0
2.5
EXAMPLE 1
EXAMPLE 2
COMPARATIVE EXAMPLE 1
COMPARATIVE EXAMPLE 2
COMPARATIVE EXAMPLE 3
COMPARATIVE EXAMPLE 4
SMOOTHNESS
SOFTNESS
MOIST FEELING
PREFERENCE

TISSUE PAPER

TECHNICAL FIELD

The present invention relates to a tissue paper, and particularly to a non-moisturizing tissue paper to which a polyol such as glycerin is not applied by external addition.

BACKGROUND ART

The tissue paper is roughly classified into a moisturizing tissue in which a hygroscopic polyol such as glycerin is applied to base paper, and a non-moisturizing tissue to which a polyol is not applied by external addition.

Furthermore, the non-moisturizing tissue to which a polyol is not applied by external addition includes a general-purpose type having a basis weight per ply of about 12 g/m$^2$ and placing importance on price, which is called a general-purpose tissue, and a product group having a high basis weight of 14.0 g/m$^2$ or more and considered to be a high-price and high-grade product.

The latter tissue paper having a high basis weight is considered to be a high-grade product like a moisturizing tissue as compared with a general-purpose type, and has such an advantage that the tissue paper gives a less sticky feeling derived from a polyol, gives a dry feeling, and is unlikely to transfer a chemical agent onto the skin, for example.

Conventionally, in order to develop softness and smoothness as a high-grade product while having a high basis weight and a large thickness, in a tissue paper belonging to this type of product group, the density of the paper has been reduced using a bulking agent, and a cushioning property particularly in a thickness direction has been developed.

CITATION LIST

Patent Literature

Patent Literature 1: JP 2017-1132233 A

SUMMARY OF INVENTION

Technical Problem

However, it is difficult to further improve the softness only by reducing the density of the paper and increasing the cushioning property in the thickness direction. In addition, an increase in the water content like a moisturizing tissue easily develops softness. However, the increase in the water content may make it difficult to develop such an advantage that the tissue has excellent softness while giving a dry feeling unique to a non-moisturizing high-grade tissue.

Therefore, a main object of the present invention is to provide a non-moisturizing tissue paper having excellent softness and smoothness and having a high basis weight per ply of 14.0 g/m$^2$ or more.

Solution to Problem

A first means for solving the above problem is a two-ply tissue paper to which a polyol is not applied by external addition, the tissue paper having a basis weight per ply of 14.0 to 17.0 g/m$^2$, a paper thickness for two plies of 160 to 220 μm, and a water content of 4.0 to 9.0% by mass, containing 0.15 to 0.45% by mass of an oily component to be extracted with diethyl ether, and having a bending rigidity of less than 0.006 gf·cm/cm in CD (cross direction) and a bending recovery force of less than 0.005 gf·cm/cm in CD.

A second means is the tissue paper according to the first means, having a dry tensile strength of 200 to 350 cN mm in MD (machine direction) and a dry tensile strength of 50 to 90 cN mm in CD.

Advantageous Effects of Invention

The present invention described above provides a non-moisturizing tissue paper having excellent softness and smoothness and having a high basis weight per ply of 14.0 g/m$^2$ or more.

BRIEF DESCRIPTION OF DRAWINGS

FIG. 1 is a graph illustrating results of a sensory evaluation in Examples according to the present invention, Comparative Examples, and Conventional Examples.

DESCRIPTION OF EMBODIMENTS

Hereinafter, embodiments of the present invention will be described. A tissue paper according to the present invention is a polyol-unapplied tissue paper to which a polyol is not externally added by application or the like. At least glycerin, 1,3-butylene glycol, propylene glycol, 3-methyl-1,3-butanediol, 1,3-propanediol, and 2-methyl-1,3-propanediol are polyols referred to in the present invention. These polyols are not applied by external addition to the tissue paper according to the present invention.

Furthermore, the number of plies of the tissue paper according to the present invention is two. The tissue paper according to the present invention belongs to a product category having a higher basis weight than a tissue paper called a general-purpose type having a basis weight per ply of 14.0 g/m$^2$ or more, and particularly has a basis weight in a range of 14.0 to 17.0 g/m$^2$. When the tissue paper has a basis weight of less than 14.0 g/m$^2$, a feeling of thickness or a feeling of bulkiness is not easily developed. Therefore, a difference from a low-price general-purpose product is not easily felt. The basis weight is preferably 14.5 g/m$^2$ or more. The higher an upper limit of the basis weight is, the better the feeling of thickness is. However, when the basis weight is excessively high, it is difficult to develop softness, and therefore the basis weight is 17.0 g/m$^2$ or less, and more preferably 16.5 g/m$^2$ or less. The paper thickness for two plies is 160 to 220 μm. Within the above range of the basis weight, the tissue paper has a low density and gives a cushioning feeling.

Here, the basis weight in the present invention means a value measured according to JIS P 8124 (1998). The paper thickness means a value obtained by sufficiently subjecting a test piece to humidity control under conditions of JIS P 8111 (1998), and then measuring the paper thickness using a dial thickness gauge (thickness measuring instrument) "PEACOCK G type" (manufactured by Ozaki MFG. Co., Ltd.) under the same conditions. Specifically, the paper thickness is measured by confirming that there is no rubbish, dust, or the like between a plunger and a measuring table, placing the plunger on the measuring table, moving a scale of the dial thickness gauge to adjust a zero point, then raising the plunger, placing a sample on a test table, lowering the plunger slowly, and reading the current gauge. At this time, the plunger is just placed. A terminal of the plunger is made of metal, and a circular plane thereof with a diameter of 10 mm strikes perpendicularly to a paper plane, and a load is about 70 gf when the paper thickness is measured. The paper thickness is the average of values obtained by performing the measurement 10 times.

Meanwhile, the tissue paper according to the present invention is has better softness and smoothness than a conventional product within the above range of the basis weight and the paper thickness, in other words, in a non-moisturizing high-grade type.

The tissue paper according to the present invention characteristically contains 0.15 to 0.45% by mass of an oily component to be extracted with diethyl ether. The tissue paper preferably contains 0.20 to 0.35% by mass of an oily component. Diethyl ether effectively extracts oils and fats which are low polar substances. Pulp, which is a main raw material of the tissue paper, does not contain an oily component. Therefore, the oily component according to the present invention is derived from an internal additive and contained in the tissue paper. Note that as a tissue paper containing an oily component, there is a tissue paper to which an oily component such as silicone or polysiloxane is applied by external addition. However, the above range is a range in which it is difficult to uniformly apply the oily component by external addition, and a range in which it is difficult to develop an effect in application by external addition. The inventors have found that the content of an oily component in the range of 0.15 to 0.45% by mass is a high content not found in a conventional non-moisturizing tissue regardless of whether a tissue paper is a general-purpose type with a low basis weight or a high-grade type with a high basis weight. When the content of an oily component is less than 0.15% by mass, an effect of improving softness and smoothness is small. When the content of an oily component exceeds 0.45% by mass, cost is high and manufacturing is difficult.

The tissue paper according to the present invention contains a large amount of an oily component derived from an internal additive and to be extracted with diethyl ether. That is, the tissue paper according to the present invention contains a large amount of an oily component covering a surface of pulp fibers, and develops high smoothness of the surface due to the film of the oily component and high softness due to a strong action of weakening a hydrogen bond between pulp fibers. Furthermore, the tissue paper according to the present invention contains a large amount of an oily component covering a surface of pulp fibers, and therefore retains moisture of pulp by an emollient effect. That is, the oily component itself does not have a hygroscopic effect, but does not impair the effect of retaining moisture absorbed by the pulp fibers themselves, and does not excessively lower a moist feeling.

Here, in order to obtain a high content of an oily component, the addition amount of a softening agent containing oils and fats may be increased, or the oils and fats in the softening agent may be increased. However, the oils and fats to be extracted with diethyl ether are low polar substances. Therefore, generally, even if the addition amount of the softening agent is simply increased, a fixing ratio to the fibers is unlikely to be increased. In addition, an adhesion ratio to a dryer may be reduced and workability may be deteriorated. Therefore, in order to increase the fixing ratio of oils and fats to be extracted with diethyl ether to the fibers, it is preferable to increase chances of contact between pulp and oils and fats. For example, it is only required to set the concentration of an active component in a weak cationic acidic softening agent containing a nonionic activator and a cationic activator to a low concentration of 25 to 35% by mass, to set a viscosity thereof to 500 mPa·s or less, and to supply the softening agent in a dispersed state to a paper raw material slurry at appropriate places of papermaking equipment such as a machine chest or a seed box.

The use amount of the softening agent is adjusted depending on the kind of the softening agent, but is about 0.2 to 0.5% by mass with respect to the total weight of the pulp fibers. When the use amount is less than 0.2% by mass, a sufficient softening effect is not be necessarily obtained. When the use amount exceeds 0.5% by mass, a fixing ratio is not necessarily increased.

The kind of the softening agent is not necessarily limited, but a combination of a cationic surfactant and a nonionic surfactant is preferable as described above. In addition, an emollient component such as a higher alcohol, a fatty acid ester, or an acylamino acid ester can be added within a range that does not impair the action and effect of the present invention. In addition, a small amount of a moisturizer or the like can be added within a range that does not impair the action and effect of the present invention, but the humectant or the like does not include an externally added polyol.

Specific examples of the emollient component include avocado oil, almond oil, olive oil, camellia oil, sesame oil, rice bran oil, safflower oil, soybean oil, corn oil, rapeseed oil, apricot kernel oil, persic oil, peach kernel oil, castor oil, sunflower oil, grape seed oil, cottonseed oil, coconut oil, wheat germ oil, rice germ oil, evening primrose oil, hybrid sunflower oil, macadamia nut oil, meadow foam oil, hazelnut oil, palm kernel oil, palm oil, coconut oil, cocoa butter, Shea fat, wood wax, mink oil, turtle oil, egg yolk oil, beef tallow, milk fat, lard, horse oil, jojoba oil, carnauba wax, candela wax, rice bran wax, orange roughy oil, beeswax, shellac, lanolin, montan wax, squalene, squalane, a hydrocarbon such as liquid paraffin, paraffin, microcrystalline wax, petrolatum, soft liquid isoparaffin, hydrogenated polyisobutylene, ozokerite, ceresin, α-olefin oligomer, polybutene, or polyethylene, lauric acid, myristic acid, palmitic acid, stearic acid, behenic acid, hydroxystearic acid, oleic acid, linoleic acid, ethylhexanoic acid, isostearic acid, isopalmitic acid, isotridecanoic acid, isononanoic acid, pentadecanoic acid, lauryl alcohol, stearyl alcohol, cetearyl alcohol, behenyl alcohol, cetanol, oleyl alcohol, lanolin alcohol, cholesterol, isocholesterol, sitosterol, stigmasterol, isostearyl alcohol, octyldodecanol, hexyldecanol, isopropyl myristate, isopropyl palmitate, butyl stearate, ethyl oleate, cetyl palmitate, myristyl myristate, octyldodecyl myristate, octyldodecyl oleate, cholesteryl stearate, cholesteryl hydroxystearate, tricaprin, trimyristin, trioctanoin, isopropyl isostearate, ethyl isostearate, cetyl ethylhexanoate, stearyl ethylhexanoate, glyceryl triethylhexanoate, trimethylolpropane triethylhexanoate, pentaerythrytyl tetraethylhexanoate, glyceryl triisostearate, trimethylolpropane triisostearate, pentaerythrytyl tetraisostearate, pentaerythrytyl triisostearate, isocetyl isostearate, octyldodecyl dimethyloctanoate, myristyl lactate, cetyl lactate, trioctyldodecyl citrate, and diisostearyl malate. These compounds can be used singly or in combination of two or more kinds thereof.

The cationic surfactant can be appropriately selected from a quaternary ammonium salt, an amine salt, an amine, and the like. Particularly, a preferable cationic surfactant is a quaternary ammonium salt, which is preferably used. Specific examples of the quaternary ammonium salt include dilauryldimethylammonium chloride, distearyldimethylammonium chloride, dimyristyldimethylammonium chloride, dipalmityldimethylammonium chloride, and distearyldimethylammonium chloride.

As the nonionic surfactant, an ester type, an ether type, an ester ether type, an alkanolamide type, an alkyl glycoside, and the like can be used. Examples of the ester type include a sorbitan fatty acid ester, diethylene glycol monostearate, diethylene glycol monooleate, glyceryl monostearate, glyceryl monooleate, propylene glycol monostearate, N-(3-oleyloxy-2-hydroxypropyl) diethanolamine, polyoxyethylene hydrogenated castor oil, polyoxyethylene sorbit beeswax, polyoxyethylene sorbitan sesquistearate, polyoxyethylene monooleate, and polyoxyethylene monolaurate. Examples of the ether type include a polyoxyethylene alkyl ether and a polyoxyethylene alkylphenyl ether, and specific examples thereof include polyoxyethylene cetyl ether and polyoxyethylene lauryl ether.

Here, the ratio of an oily component to be extracted with diethyl ether in the present invention is a value measured by a quick residual fat extraction device OC-1 manufactured by Intec Co., Ltd., or its equivalent machine or compatible machine. In this device, a sample is put in an attached test tube having an extraction port at a lower portion thereof, and when a solvent is supplied thereto, an extraction liquid drops from the extraction port into a heated aluminum pan located below, and only the solvent evaporates. The mass of an extract is determined from a difference in the mass of the aluminum pan between before and after dropping of the extraction liquid, and an oily component in the sample can be measured quickly and easily. Then, the ratio of the extract can be calculated from the mass of the extract and the mass of the sample. In the present invention, as the sample, two sets of tissue paper in which one set includes two plies are used, and the amount of diethyl ether used is 10 cc. Pushing with a push rod is started 60 seconds after addition of diethyl ether.

Meanwhile, the tissue paper according to the present invention has a bending rigidity of less than 0.006 gf·cm/cm in CD and a bending recovery force of less than 0.005 gf·cm/cm in CD. Values in these ranges are low for a non-moisturizing tissue paper having a high basis weight per ply of 14.0 g/m$^2$ or more. The tissue paper according to the present invention contains a large amount of an oily component, has a bond between fibers weakened, and therefore exhibits remarkable characteristics in physical properties relating to a paper force in CD of the paper. The bending rigidity in CD and the bending recovery force in CD indicate values when a sample is bent at a right angle to a flow direction of the sample, and a bending rigidity in MD and a bending recovery force in MD indicate values when a sample is bent parallel to a flow direction of the sample. The bending rigidity in CD and the bending recovery force in CD are indicators of bending in a direction orthogonal to a crepe ridge. Therefore, when the bending rigidity in CD and the bending recovery force in CD are low, a sample is supple and easily gives a feeling of softness. Note that the bending rigidity in CD and the bending recovery force in CD according to the present invention are values measured by a pure bending tester KES-FB2-A manufactured by Kato Tech Co., Ltd., or an equivalent machine thereto or a measuring device having a compatible function therewith. At the time of measurement, a sample that has been subjected to humidity control for three hours or more in a constant temperature and humidity room at 23° C. and 50% is used, the size of the sample is 200×200 mm, the number of measurements is N=5, and an average value thereof is used as a measurement value. The bending rigidity correlates with softness and rigidity felt by a person when the person bends an object. The larger a value of the bending rigidity is, the more rigid a tissue paper is. The smaller a value of the bending rigidity is, the softer a tissue paper is. The bending recovery force correlates with recoverability (elasticity) felt by a person when the person bends an object and restores the object to an original state. The larger a value of the bending recovery force is, the poorer the recoverability is. The smaller a value of the bending recovery force is, the better the recoverability is.

Furthermore, it is desirable that the tissue paper according to the present invention has a dry tensile strength of 200 to 300 cN in MD and a dry tensile strength of 50 to 90 cN in CD. A particularly preferable dry tensile strength in CD is 55 to 85 cN. When the dry tensile strength in MD is within a range of 200 to 300 cN, the dry tensile strength is sufficient. Meanwhile, when the dry tensile strength in CD is less than 50 cN, the tissue paper tends to break during use. When the dry tensile strength in CD exceeds 90 cN, an effect of improving softness is not easily felt. The tissue paper according to the present invention has a low dry tensile strength particularly in CD. The dry tensile strength in MD is a paper force in a direction in which a crepe is stretched, and therefore the strength is easily adjusted by the crepe. Note that a preferable crepe ratio during manufacture of the tissue paper according to the present invention is 15 to 28%. Meanwhile, the dry tensile strength in CD is a paper force in a direction orthogonal to MD in which the crepe is stretched, and therefore largely depends on a bond between fibers and has an influence on a feeling of softness. The dry tensile strength in CD according to the present invention is slightly lower than that of a conventional high-grade type tissue paper, and this seems to be because the ratio of an oily component extracted with diethyl ether is large and therefore a hydrogen bond between fibers is weakened. In the tissue paper according to the present invention, the dry tensile strength particularly in MD is in a general range, but the dry tensile strength particularly in CD is slightly low, and therefore a feeling of softness is easily felt. Note that the dry tensile strength according to the present invention refers to a value measured on the basis of the tensile test of JIS P 8113 (1998). Note that a known dry paper strength agent can be used in the adjustment of the dry tensile strength of the present invention. As described above, the tissue paper according to the present invention has a weaker dry tensile strength in CD than a conventional non-moisturizing high basis weight high-grade type, more specifically than a non-moisturizing tissue having a basis weight of 14.0 g/m$^2$ or more. Furthermore, the tissue paper according to the present invention has a lower bending rigidity in CD and a lower bending recovery force in CD than the conventional non-moisturizing high basis weight high-grade type, and therefore has excellent softness and smoothness.

Meanwhile, the tissue paper according to the present invention is a non-moisturizing tissue paper. The water content of the tissue paper is roughly within a range of 4.0 to 9.0% by mass, and is generally 4.0 to 8.0% by mass. Note that the water content here is measured as follows. Two sets of samples are taken from a measurement target and are subjected to humidity control for three hours in a constant temperature and humidity room at 23° C. and 50%. Each of the samples is put in a weighing bottle, the weighing bottle is sealed, and the mass thereof is measured. Subsequently, the weighing bottle is placed in a dryer adjusted to 105±3° C. with a lid of the weighing bottle removed, and the sample is dried for four hours. The weighing bottle is covered with the lid in the dryer, and then removed from the dryer. The temperature is caused to naturally drop to room temperature. 15 to 20 minutes later, the mass of the weighing bottle containing the sample is measured. Next, the water content is calculated from a formula of water content (% by mass)=((mass of weighing bottle+sample before drying)−(mass of weighing bottle+sample after drying))/((mass of weighing bottle+paper before drying)−(mass of weighing bottle)))×100. Here, when a difference in water content (% by mass) between the two samples is within 1.0% by mass, an average value thereof is adopted as the water content (% by mass) of the sample. Note that the water content is expressed in % with one decimal place. Meanwhile, when the difference in water content between the two sets of samples exceeds 1.0% by mass, the test is performed again.

The tissue paper according to the present invention is a non-moisturizing tissue and has a water content within a range of 4.0 to 9.0% by mass. A moisturizing tissue generally has a water content of more than 10% by mass, and this water content is a clear difference from a non-moisturizing tissue. Unlike a tissue paper with an increased water content obtained by adding a hygroscopic moisturizer externally as in a moisturizing tissue, in the tissue paper according to the present invention, a dry feeling is felt, but a high-grade sense is also felt with a feeling of thickness.

Here, the tissue paper according to the present invention does not contain glycerin as an externally added polyol as described above, but it is desirable that the tissue paper does not contain glycerin as an internal additive. Glycerin enhances the water content due to high hygroscopicity thereof, but develops a sticky feeling when glycerin is contained. In other words, the present invention achieves a high water content and a high content of an oily component without containing glycerin. Furthermore, it is desirable that the tissue paper according to the present invention does not contain a polyhydric alcohol having a valence of 3 or more. These compounds are oily components, but develop a sticky feeling.

Meanwhile, it is desirable that pulp fibers in the tissue paper according to the present invention are obtained by blending needle bleached kraft pulp (NBKP) and leaf bleached kraft pulp (LBKP). Particularly, the pulp fibers preferably include only NBKP and LBKP, and a blending ratio is preferably NBKP:LBKP=20:80 to 80:20. Particularly, it is desirable that the blending ratio is NBKP:LBKP=30:70 to 60:40. Paper strength, softness, and the like can be adjusted by the blending ratio between NBKP and LBKP. In addition, the tissue paper according to the present invention can contain known fibers such as chemical fibers, kenaf fibers, and cotton fibers within a range that does not impair the effect of the present invention.

Examples

Next, for Examples and Comparative Examples of the tissue paper according to the present invention, physical property values were measured, and a sensory test was performed. Composition/physical property values in each example are as illustrated in Table 1 below. A method for measuring each of the physical property values is as described above. Note that high-grade type conventional commercial products were used in Comparative Examples 1 to 4. In Examples 1 and 2, a weak cationic acidic softening agent containing a nonionic activator and a cationic activator was used as a softening agent by setting the concentration of an active component to a low concentration of 25 to 35% by mass and setting a viscosity to 500 mPa·s or less so as to increase a fixing ratio. The use amounts of the softening agent in Examples 1 and 2 were 0.32% by mass and 0.38% by mass in terms of pulp mass ratio, respectively. Pulp fibers in Examples 1 and 2 are 100% virgin pulp and do not contain used paper pulp.

In the sensory test, evaluation was made as follows. The sample in Comparative Example 1 was used as a reference sample. In Comparative Example 1, softness and smoothness were highly evaluated in advance, and the amount of an oily component extracted with diethyl ether was the highest among those in Comparative Examples. As an evaluation method, the reference sample was evaluated with 4 points, and the samples in the other examples were evaluated with 1 to 7 points in comparison with the reference sample. Note that as rough criteria, criteria of 1 point: much worse than the reference sample (unfavorable), 2 points: worse than the reference sample (unfavorable), 3 points: slightly worse than the reference sample (unfavorable), 4 points: the same as the reference sample, 5 points: slightly better than the reference sample (favorable), 6 points: better than the reference sample (favorable), and 7 points: much better than the reference sample (favorable) were presented to test subjects.

Regarding evaluation of smoothness, smoothness was judged when one set of tissue paper was folded in half in MD, the half-folded sample was placed on a horizontal table with a smooth surface, and an index finger was slid once in CD from an end to an end. Softness, a moist feeling, and preference were evaluated by free touch to one set of tissues by a test subject. There were 11 test subjects, and each of the numerical values in the table is an average of values obtained from the test subjects. Note that FIG. 1 illustrates a graph of the results.

TABLE 1

| | | | Example 1 | Example 2 | Comparative Example 1 | Comparative Example 2 | Comparative Example 3 | Comparative Example 4 |
|---|---|---|---|---|---|---|---|---|
| Product paper quality | Amount of extracted oily component | [% by mass] | 0.240 | 0.290 | 0.100 | 0.070 | 0.066 | 0.040 |
| | Water content | [% by mass] | 6.5 | 6.2 | 6.0 | 6.4 | 6.3 | 6.7 |
| | Number of plies | [ply] | 2 | 2 | 2 | 2 | 2 | 2 |
| | Product basis weight | [g/m$^2$] | 14.9 | 15.1 | 14.7 | 16.1 | 14.9 | 15.1 |
| | Paper thickness (one set) | [μm] | 181 | 188 | 178 | 200 | 161 | 179 |
| | Dry tensile strength (MD) | [cN] | 324 | 225 | 286 | 289 | 291 | 239 |
| | Dry tensile strength (CD) | [cN] | 80 | 60 | 87 | 98 | 112 | 85 |
| Pure bending test | B (Bending rigidity) MD | [gf · cm/cm] | 0.009 | 0.006 | 0.006 | 0.006 | 0.009 | 0.006 |
| | B (Bending rigidity) CD | [gf · cm/cm] | 0.005 | 0.004 | 0.007 | 0.006 | 0.007 | 0.007 |

TABLE 1-continued

| | | | Example 1 | Example 2 | Comparative Example 1 | Comparative Example 2 | Comparative Example 3 | Comparative Example 4 |
|---|---|---|---|---|---|---|---|---|
| | 2HB (Bending recovery force) MD | [gf · cm/cm] | 0.007 | 0.007 | 0.008 | 0.008 | 0.012 | 0.007 |
| | 2HB (Bending recovery force) CD | [gf · cm/cm] | 0.004 | 0.003 | 0.006 | 0.004 | 0.005 | 0.006 |
| Sensory evaluation (N = 11) | Smoothness | | 4.3 | 5.0 | 4.0 | 4.1 | 3.3 | 4.1 |
| | Softness | | 4.8 | 5.0 | 4.0 | 3.8 | 3.0 | 3.5 |
| | Moist Feeling | | 4.3 | 5.0 | 4.0 | 3.3 | 3.0 | 4.5 |
| | Preference | | 4.8 | 5.3 | 4.0 | 4.0 | 3.5 | 3.5 |

According to the results in Table 1, the amount of an extracted oily component in each of Examples according to the present invention is twice or more as high as that of a commercially available product. That is, the samples in Examples each contain a large amount of an oily component. Meanwhile, the samples in Examples each have a water content equal to those in Comparative Examples, and it is found that the samples in Examples are not hygroscopic unlike a tissue paper containing a polyol. In addition, particularly, the samples in Examples each have a low physical property value relating to a paper force in CD. The results of the sensory evaluation in Examples are very good not only in comparison with Comparative Example 4 using the reference sample but also in comparison with all the other Comparative Examples.

Here, when Examples are compared with Comparative Example 2, the bending recovery force in CD in Comparative Example 2 is equal to that in Examples, but the bending rigidity in CD in Comparative Example 2 is higher. In addition, evaluation of softness in Comparative Example 2 is lower. That is, it can be said that the softness is significantly increased when both the bending recovery force in CD and the bending rigidity in CD are low. Furthermore, when Comparative Examples 3 and 4 are compared with each other, the sample in Comparative Example 3 has a larger amount of an extracted oily component but has a poorer result in the sensory evaluation than the sample in Comparative Example 3. One of possible reasons for this is that the dry tensile strength in CD in Comparative Example 4 is lower than that in Comparative Example 4.

From the above, the present invention provides a non-moisturizing tissue paper having excellent softness and smoothness and having a high basis weight per ply of 14.0 to 17.0 g/m$^2$.

The invention claimed is:

1. A two-ply tissue paper to which a polyol is not applied by external addition, wherein the tissue paper has a basis weight per ply of 14.0 to 17.0 g/m$^2$, a paper thickness for two plies of 160 to 220 μm, and a water content of 4.0 to 9.0% by mass, contains a nonionic surfactant and a cationic surfactant as softening agents, said cationic surfactant comprising a quaternary ammonium salt, an amine salt, an amine, or a combination thereof, contains 0.15 to 0.45% by mass of an oily component extractable with diethyl ether, has a bending rigidity of less than 0.006 gf·cm/cm in CD (cross direction) and a bending recovery force of less than 0.005 gf·cm/cm in CD, has a dry tensile strength of 200 to 350 cN in MD (machine direction), and has a dry tensile strength of 60 to 80 cN in CD.

2. The two-ply tissue paper of claim 1 wherein the cationic surfactant comprises a quaternary ammonium salt.

3. The two-ply tissue paper of claim 1 wherein the cationic surfactant is a quaternary ammonium salt selected from the group consisting of dilauryldimethylammonium chloride, distearyldimethylammonium chloride, dimyristyldimethylammonium chloride, dipalmityldimethylammonium chloride, and distearyldimethylammonium chloride, and combinations thereof.

4. The two-ply tissue paper of claim 1 wherein the nonionic surfactant comprises one or more of a an ester type, an ether type, an ester ether type, an alkanolamide type, and an alkyl glycoside type nonionic surfactant.

5. The two-ply tissue paper of claim 1 wherein the nonionic surfactant is an ester type nonionic surfactant selected from the group consisting of a sorbitan fatty acid ester, diethylene glycol monostearate, diethylene glycol monooleate, glyceryl monostearate, glyceryl monooleate, propylene glycol monostearate, N-(3-oleyloxy-2-hydroxypropyl) diethanolamine, polyoxyethylene hydrogenated castor oil, polyoxyethylene sorbit beeswax, polyoxyethylene sorbitan sesquistearate, polyoxyethylene monooleate, polyoxyethylene monolaurate, and combinations thereof.

6. The two-ply tissue paper of claim 1 wherein the nonionic surfactant is an ether type nonionic surfactant selected from the group consisting of a polyoxyethylene alkyl ether and a polyoxyethylene alkylphenyl ether, polyoxyethylene cetyl ether, polyoxyethylene lauryl ether, and combinations thereof.

7. The two-ply tissue paper of claim 1 made by:

A) dispersing a softening agent comprising a nonionic surfactant and a cationic surfactant, at a low active component concentration of 25 to 35% by mass and at a viscosity of 500 mPa·s or lower to a paper raw material slurry at one or more suitable locations in a papermaking facility; and B) forming the two-ply tissue paper of claim 1 from said paper raw material slurry.

* * * * *